US005366005A

United States Patent [19]

Kadle

[11] Patent Number: 5,366,005

[45] Date of Patent: Nov. 22, 1994

[54] HEAT EXCHANGER ASSEMBLY INCORPORATING A HELICAL COIL OIL COOLER

[75] Inventor: Prasad S. Kadle, Getzville, N.Y.

[73] Assignee: General Motors Corporation, Detroit, Mich.

[21] Appl. No.: 82,636

[22] Filed: Jun. 28, 1993

[51] Int. Cl.[5] ..... F28D 7/02

[52] U.S. Cl. ..... 165/140; 165/916; 123/41.33

[58] Field of Search ..... 165/144, 145, 140, 916; 123/41.33, 41.51

[56] References Cited

U.S. PATENT DOCUMENTS

| | | | |
|---|---|---|---|
| 2,054,238 | 9/1936 | Booth | 123/196 |
| 3,162,998 | 12/1964 | Williams | 123/41.33 X |
| 3,265,126 | 8/1966 | Donaldson | 165/140 |
| 3,486,489 | 12/1969 | Huggins | 165/140 X |
| 4,424,778 | 1/1984 | Yoshida | 123/196 AB |
| 4,535,729 | 8/1985 | Faylor | 123/41.1 |
| 4,923,001 | 5/1990 | Marcolin | 165/140 |
| 5,009,262 | 4/1991 | Halstead et al. | 165/140 |

FOREIGN PATENT DOCUMENTS 3818 of 1914 United Kingdom .

*Primary Examiner*—Allen J. Flanigan
*Attorney, Agent, or Firm*—Patrick M. Griffin

[57] ABSTRACT

A heat exchanger assembly (10) includes a radiator section (25) with an helical coil tube (62) mounted within an outlet tank chamber (21) of a radiator tank (26). Oil flows through the helical coil tube to be cooled by coolant within the chamber (21). The oil then flows to an air-to-oil cooler (76) that is integrally mounted to either the radiator or a condenser (30) whereby the oil is further cooled.

15 Claims, 2 Drawing Sheets

HEAT EXCHANGER ASSEMBLY INCORPORATING A HELICAL COIL OIL COOLER

TECHNICAL FIELD

The field of this invention relates to a helical coil oil cooler mounted within a radiator of a motor vehicle.

BACKGROUND OF THE DISCLOSURE

Heat exchangers for automotive vehicles include radiators, oil coolers, or condensers in vehicle air conditioning systems. Many of these heat exchangers utilize tubes carrying oil, coolant or refrigerant and cooling fins, also called air centers, interposed between the tubes to effectively increase the contact with air for heat transfer to the air. A great impetus for increasing the efficiency of heat exchangers has arisen by the need for more fuel efficient and aerodynamic motor vehicles.

The aerodynamic shape of many motor vehicles dictate that the hood line of the motor vehicle be lowered resulting in less space available in the engine compartment particularly in the vertical direction. Two of the largest components in the engine compartment are the radiator and condenser. The lower hood lines dictate for radiators with less core face area. Any decrease in core face area, overall size and weight of the radiator or condenser must therefor be accompanied by an increase in efficiency for heat transfer for a given air flow to provide adequate heat exchange for the oil cooler, radiator and condenser.

Arrangements have been proposed for combining structural and cooling components of radiators and condensers. Some proposals call for the sharing of air centers while other proposals call for the integration of the inlet tanks and outlet tanks of the radiators and condensers by providing sealed chambers within each tank. Other proposals call for incorporating air to oil coolers integrated with the radiator and condenser. Such proposals are described in U.S. Pat. No. 5,009,262 issued to Halstead et al. The integration of the radiator, condenser and oil cooler as taught by U.S. Pat. No. 5,009,262 is incorporated herein by reference.

Heat exchangers for cooling engine oil or transmission fluid, commonly called oil coolers, are often installed in the vehicle radiator so that coolant flows about the exterior of the oil cooler to carry heat away from the oil cooler. This type of oil cooler must be compact in size to fit within a small allocated space inside the engine radiator.

Another type of oil cooler is commonly known as an air-to-oil cooler because it uses air flow about cooling tubes that contain the oil to provide heat transfer from the oil. Both types of oil coolers must be constructed to withstand significant internal oil pressure. They also must have a high heat transfer efficiency to adequately cool the oil passing therethrough.

Due to the properties of oil, namely its high viscosity relative to its low thermal diffusivity, often referred to as a high Prandtl number, thermal boundary layers of the oil need to be broken up throughout the entire oil cooler to increase heat transfer.

What is needed is an improvement arrangement for an oil cooler, with a radiator or condenser for providing sufficient heat exchange in a small integrated package. What is also needed is an oil cooler that is easily constructed and has improved heat transfer efficiency.

SUMMARY OF THE DISCLOSURE

In accordance with one aspect of the invention, an oil cooler assembly for an automotive motor includes a first coil tube mounted within a tank of a radiator for a motor. Furthermore, the coil has an inlet end for receiving lubricant fluid such as natural or synthetic oil from without the tank and for allowing heat transfer from the lubricant fluid without the coil tube through the coil tube to coolant flowing through the radiator. The coil tube has an outlet end for transferring the oil from within said coil to an inlet of an air-to-oil cooler where the oil is further cooled by air flow about said air-to-oil cooler.

Preferably, the coil tube is helical and has turbulence enhancing projections on an inside surface. The helical coil tube has extensions on its outer surface for increasing heat transferring surface area. A second helical coil tube may be mounted in parallel with the first helical coil for parallel flow of oil within both said first and second helical coil tubes to the air-to-oil cooler.

In one embodiment, an integrated heat exchanger for the cooling of first and second cooling fluids for a motor vehicle has a first tank member with a first chamber. The chamber has an inlet for receiving the first cooling fluid. A plurality of cooling tubes extend from the first chamber and are in fluid communication with an outlet for allowing the first cooling fluid to exit therefrom. The first tank member has a second chamber with an inlet for receiving the second fluid. The first chamber and second chamber are sealed from one another. At least one second fluid cooling tube extends from the second chamber and is in fluid communication with a second outlet for allowing the second fluid to exit. The plurality of cooling tubes have air centers interposed therebetween for transferring heat from the tubes. The first chamber forms a radiator tank which has mounted therein the first coil tube. The coil tube has an outlet end for transferring the second fluid from within the coil tube to the second chamber which forms the tank of an air-to-oil cooler.

BRIEF DESCRIPTION OF THE DRAWINGS

Reference now is made to the accompanying drawings in which.

DETAILED DESCRIPTION OF THE PREFERRED EMBODIMENT

Figure 1:
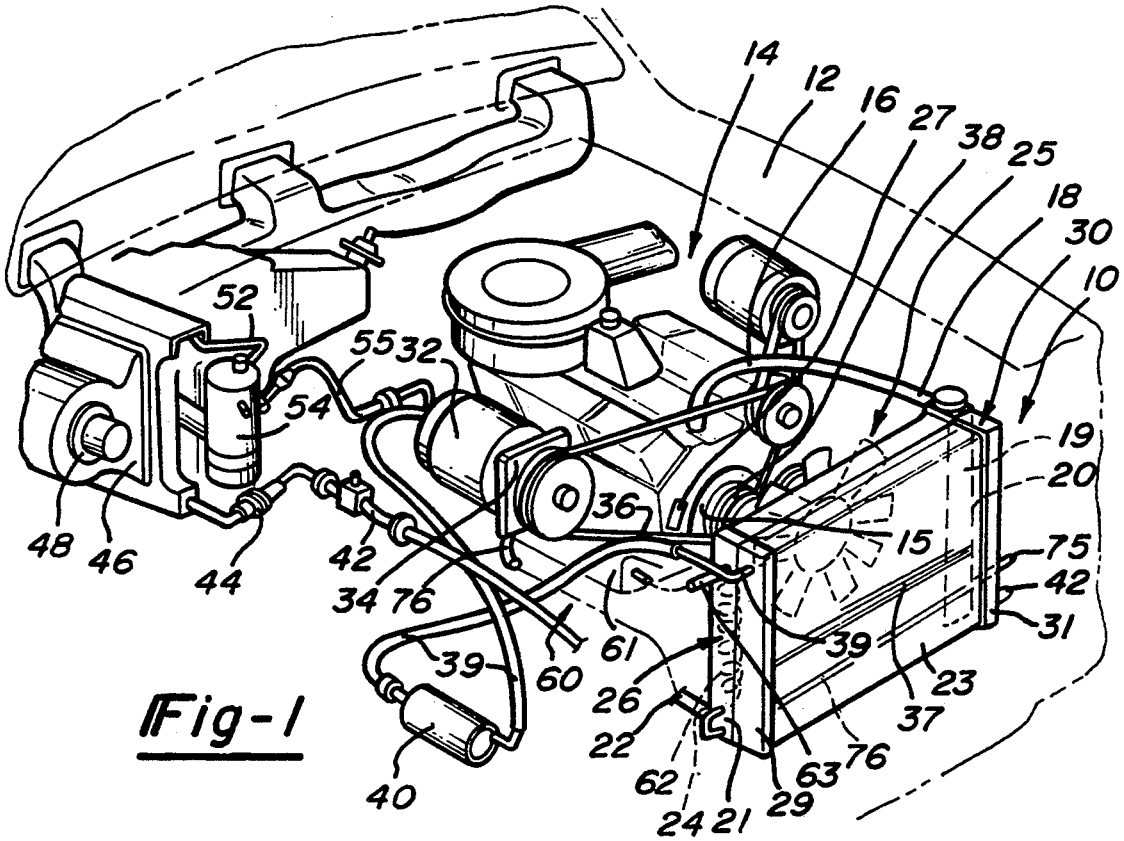
FIG. 1 is a perspective view of an automobile coolant system including the oil cooler and radiator assembly in accordance with the invention.

Referring now to FIG. 1, a combination radiator and oil cooler assembly 10 is shown installed in the engine compartment of a motor vehicle 12 having a liquid cooled engine 14. The assembly 10 includes a tank 20 having inlet chamber 19 and an tank 26 having an outlet chamber 21 with a radiator section 25 therebetween. The radiator section 25 includes radiator cooling tubes 35 extending out from tank 20 to tank 26. The tubes 35 have air centers 23 therebetween for being in contact with an air flow therethrough. A coolant pump 15 on the engine 14 directs liquid from the coolant passages of the engine for discharge through a radiator hose 16 which connects to an inlet fitting 18 on the radiator tank 20 of the assembly 10. An outlet radiator hose 22 connects to the outlet fitting 24 on the tank 26 and to the coolant jacket inlet 27.

The vehicle has a condenser 30 which is connected at its inlet tank 29 to the discharge line 39 of a refrigerant compressor 32. The condenser 30 is located directly in front of the radiator and oil cooler assembly 10 to receive the air flow as it initially enter the engine compartment. The compressor 32 is driven through an electromagnetic clutch 34 by a belt 36 driven from the engine pulley 38 during engine operation. The discharge line 39 has a muffler 40. The refrigerant entering the condenser inlet tank 29 is at high pressure and in gaseous vapor form. Tubes extend between inlet tank 29 and outlet tank 31. The tubes 37 between tanks 29 and 31 share the same air centers 23 as tubes 35 for preventing flow disturbances in the air intake stream of the vehicle across parallel tube passes and air centers therein.

High pressure refrigerant vapor condenses in the condenser 30 and the refrigerant exits the condenser 30 at high pressure but in liquid form at outlet tank 31 and through a high pressure line 42. The high pressure liquid line 42 is connected to an expansion device 44 (as shown an orifice tube or capillary tube) installed immediately upstream of an evaporator 46. Air is drawn through the evaporator on the air side thereof by an electric motor driven blower 48 and is blown at a reduced temperature into the passenger compartment.

Low pressure refrigerant vapor exits the evaporator 46 through a suction line 52 having an accumulator dehydrator unit 54 and is then returned to the suction inlet of the compressor 32 via line 55.

Figure 2:
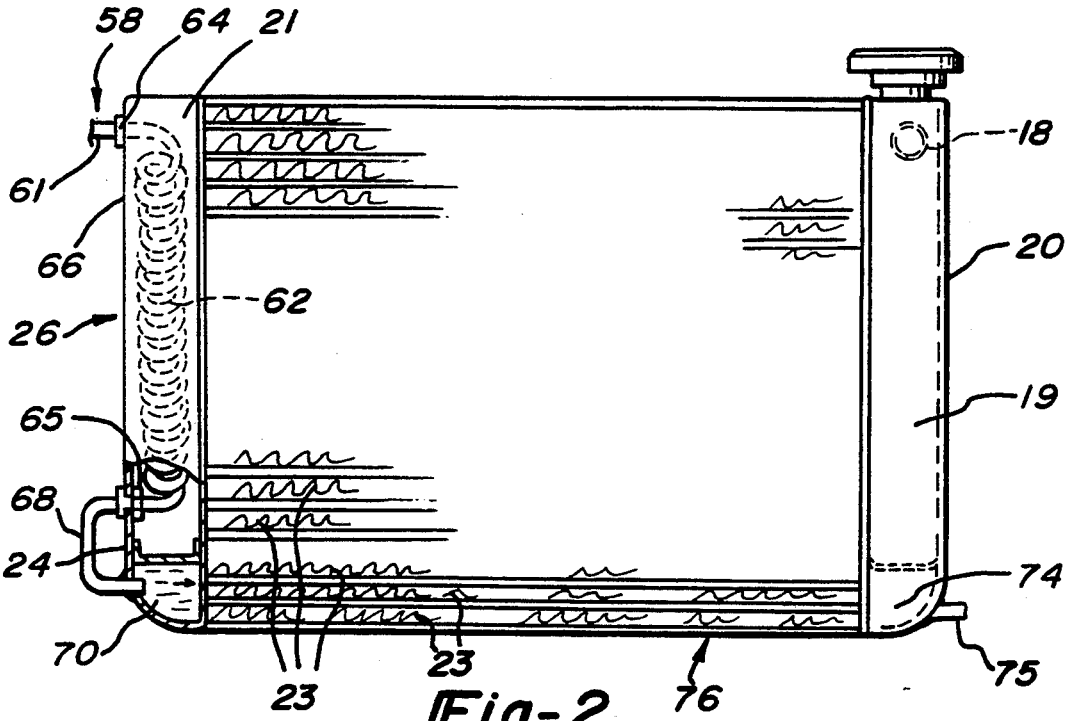
FIG. 2 is an enlarged front elevational view of the oil cooler and radiator assembly.

As more clearly shown in FIGS. 1 and 2, the assembly 10 further includes an oil cooling system 58 which is connected to receive either the engine oil or transmission oil of the vehicle. Future reference will refer to engine oil with the understanding that the oil cooling system may be used with transmission oil. The engine lubricating system 60 has an oil pump (not shown) drawing oil from the oil pan 61 through a line 63 to the oil cooling system 58. The cooling system 58 includes a helical coil tube 62 mounted within outlet chamber 21.

Figure 3:
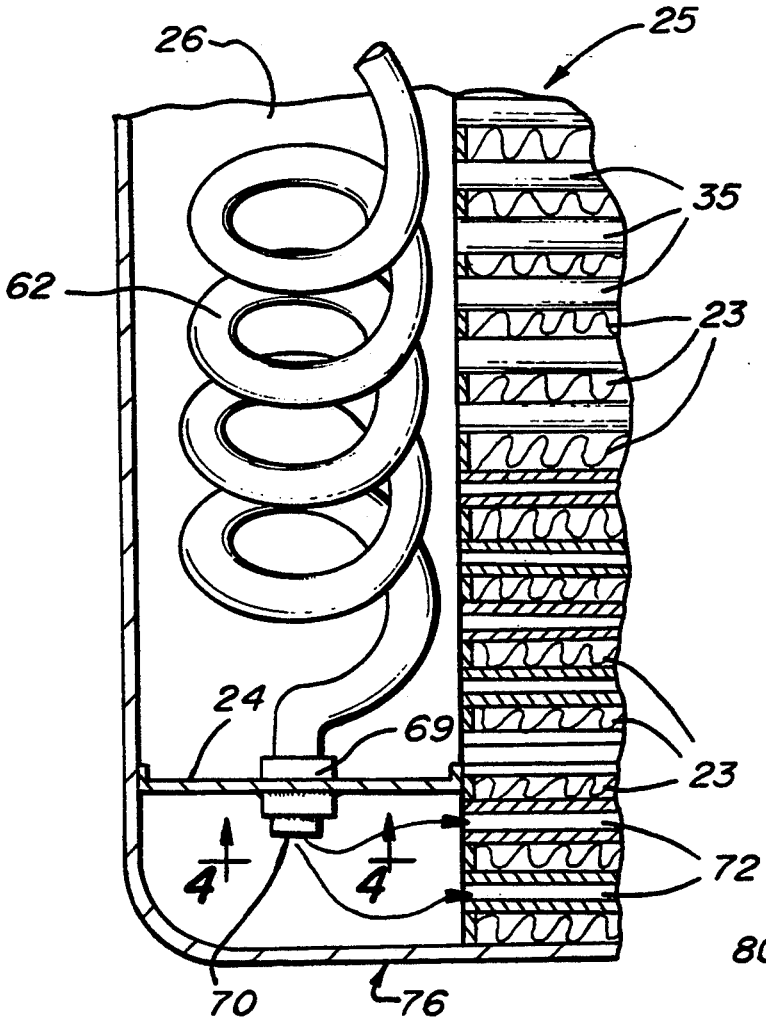
FIG. 3 is a partially segmented view of the radiator tank illustrating another embodiment in which the helical coil tube is mounted internally of the tank.

The helical coil tube 62 has an inlet 64 operably connected to line 61 through the wall 66 of tank 26. The helical coil tube 62 has an outlet end 65 fitted through wall 66 of tank 26 to an externally located intermediate line 68. The line 68 has its other end fitted to an inlet chamber 70 within tank 26. Alternatively, as shown in FIG. 3, the external intermediate line 68 can be eliminated by connecting the outlet end 65 to a fitting 69 located internally on the sealing element 24. As shown in FIG. 2, the inlet chamber 70 has oil cooling tubes 72 extending therefrom to an outlet chamber 74 within outlet tank 20 to form an air-to-oil cooler section 76. The air-to-oil cooler 76 preferably has two tubes 72 with air centers 23 interposed therebetween. An air center 23 is also interposed between one of the tubes 72 and one of the tubes 25. The chamber 19 and 74 are sealed from each other and chamber 21 and chamber 74 are also sealed from each other. Outlet chamber 74 has an outlet 75 connected to an oil return line 76. Each tank 20 and 26 is formed as a unitary extrusion. It may also be practical to form the inlet tank 29 and outlet tank 31 of the condenser integrally with tanks 20 and 26 respectively if the specific application warrants this one-piece construction.

Figure 4:
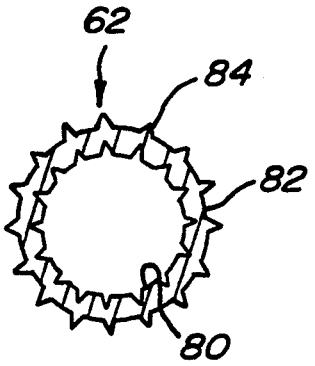
FIG. 4 is cross-sectional view of the helical coil tube taken along lines 4—4 shown in FIG. 3.

As shown in FIG. 4, the helical tube 62 may have a dimpled or otherwise convoluted interior surface 80 to enhance turbulence of the oil flowing therethrough. The exterior surface 82 may have ridges 84 to promote heat exchange with the coolant within chamber 19.

In operation, the oil is pumped from the oil pan 61 to the helical coil tube 62. Heat from the oil is transferred through the tube 62 to the coolant within chamber 19. The dimpled surface creates turbulence in the flow of the oil to promote heat transfer. Furthermore, the helical shape of the coil tube provides natural occurring vortices in the oil flow which enhance heat transfer.

The coolant lowers the temperature of the oil. It is also desirable to further cool the oil in a second step. The oil exits the helical tube 62 and is transferred to inlet chamber 70 where it enters the air-to-oil cooler 76. The cooler air passing between the air centers 23 and tubes 72 further cools the oil. The air-to-oil cooler further cools the oil because a higher temperature difference exists between ambient air and oil compared to radiator coolant and oil. The fully cooled oil then passes through outlet chamber 74 to outlet 75 and return line 76.

The radiator as shown does not suffer performance degradation because in conventional arrangements, an air-to-oil cooler is positioned in front of the radiator thereby providing hotter air for cooling the radiator. The air is no longer preheated by an oil cooler to allow the radiator to perform effectively.

Figure 5:
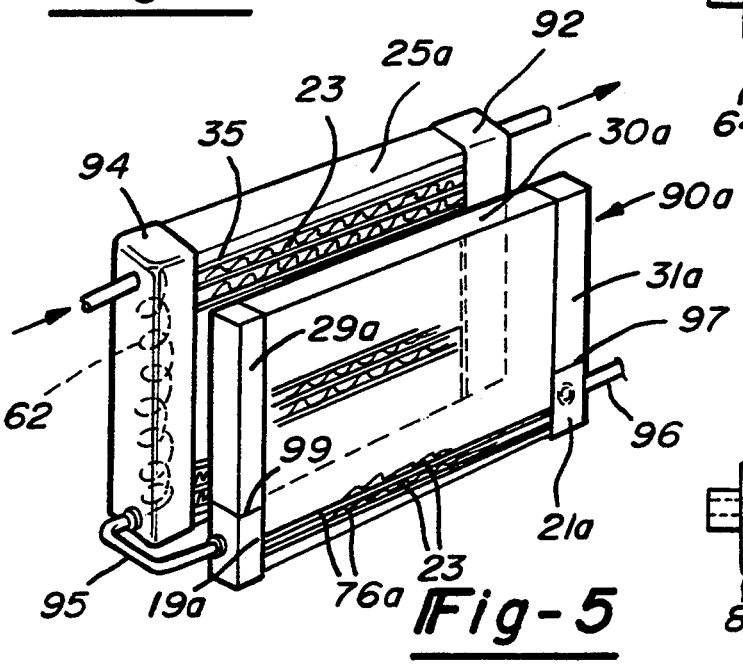
FIG. 5 is perspective view of an alternate heat exchanger incorporating a radiator, oil cooler and air conditioning condenser.

Referring now to FIG. 5, a second embodiment is illustrated. In this embodiment, the inlet chamber **29*a* of the condenser 30*a* is integrally formed with the inlet chamber 19*a* of an air-to-oil cooler 76*a* in tank unit 90. Similarly, outlet chamber 31*a* is integrally formed with outlet chamber 21*a* of the air-to-oil cooler 76*a*. Baffles 99 and 97 separate the chambers from each other. Air centers 23 are interposed between the oil cooling tubes and the tubes of the condenser. A radiator 25*a* has an inlet tank 92 and outlet tank 94 with tubes 35 and air centers 23 interposed therebetween. The helical oil tube 62 is positioned in the outlet tank 94 and operates in the same fashion as the above described first embodiment. The oil exiting the helical coil tube passes through tube 95 to the inlet chamber 19*a* and through air-to-oil cooler 76*a***.

The operation for cooling the oil is substantially the same as for the first embodiment. The oil is drawn from the oil pan 60 and passes through the helical coil 62. The oil then passes through intermediate tube 95 to chamber **19*a* and through the remainder of the air-to-oil cooler 76*a* after which the oil exits outlet 96** is then returned to the engine. The condenser performance does not undergo degradation because of the presence of the air-to-oil cooler. Normally, an air-to-oil cooler is positioned in front of the condenser to provide hotter air for cooling the condenser and radiator. The absence of a front air to oil cooler allows cooler air to cool the condenser and increase the performance efficiency.

Figure 6:
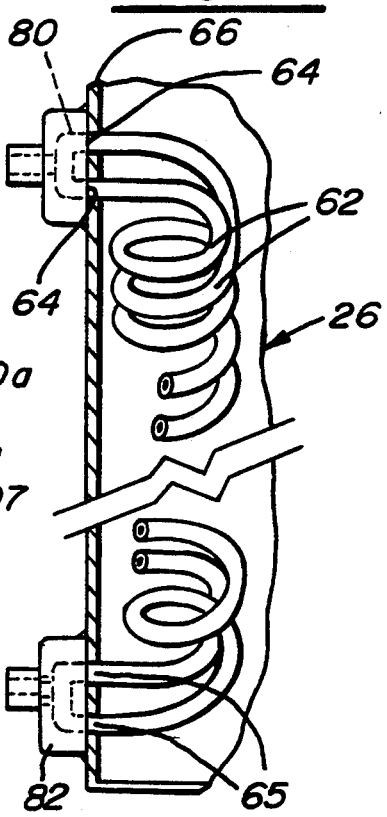
FIG. 6 is a view similar to FIG. 3 illustrating an alternate embodiment.

Referring now to FIG. 6, the tank chamber 21 has two helical coil tubes 62 mounted in parallel to each other. Each tube has its inlet 64 connected to a plenum 80 which is passes through wall 66 of tank 26. Each helical tube also has its outlet end 65 connected to a plenum 82 that passes through wall 66 of tank 26 to be connected to intermediate line 68. The two tubes allow for cooling of the oil with a lower pressure drop from the inlet 64 to the outlet 65.

Other variations and modifications are possible without departing from the scope and spirit of the present invention as defined by the appended claims.

The embodiments in which an exclusive property or privilege is claimed are defined as follows:

1. An integrated heat exchanger for the cooling of first and second cooling fluids for a motor vehicle, said heat exchanger characterized by:

a first tank member having a first chamber constructed for receiving said first cooling fluid;

a plurality of cooling tubes extending from said first chamber for allowing said first cooling fluid to pass therethrough and be cooled;

said first tank member having a second chamber constructed for receiving said second fluid, said first chamber and second chamber being sealed from one another;

at least one second fluid cooling tube extending from said second chamber for allowing said second fluid to pass therethrough and be cooled;

said plurality of cooling tubes extending from said first chamber and said at least one second fluid cooling tube having air centers interposed therebetween for transferring heat from said tubes; and a first coil tube mounted within said first chamber, said coil tube having a first end means, said coil tube having a second end means fluidly connected to said second chamber.

2. A heat exchanger as defined in claim 1 further characterized by;

said coil tube being helical.

3. A heat exchanger as defined in claim 2 further characterized by;

said helical coil tube having turbulence enhancing projections on an inside surface.

4. A heat exchanger as defined in claim 2 further characterized by;

said helical coil tube having extensions on its outer surface for increasing heat transferring surface area.

5. A heat exchanger as defined in claim 2 further characterized by;

a second helical coil mounted in parallel with said first helical coil for parallel flow of said second fluid within both said first and second helical coils.

6. A heat exchanger assembly for the cooling of a first, second and third fluids for a motor vehicle said heat exchanger characterized by:

a first tank member having an inlet for receiving said first fluid;

a plurality of cooling tubes extending from said first tank for allowing said first fluid to pass therethrough and be cooled;

a coil tube mounted within said first tank, said coil tube having a first open end for connection with tubing for transporting a second fluid, said coil tube having a second open end for allowing said second fluid to pass through said coil;

a second tank having a first chamber for receiving and delivering said second fluid;

at least one second fluid cooling tube extending from said second chamber for allowing said second fluid to pass therethrough to be cooled;

said second tank member having a second chamber with a passage for passing a third fluid, said first chamber and second chamber being sealed from one another; and a plurality of cooling tubes extending from said second chamber for allowing said third fluid to pass therethrough and be cooled.

7. A heat exchanger as defined in claim 6 further characterized by;

said coil being helical.

8. A heat exchanger as defined in claim 7 further characterized by;

said helical coil tube having turbulence enhancing projections on an inside surface.

9. A heat exchanger as defined in claim 8 further characterized by;

said helical coil tube having extensions on its outer surface for increasing heat transferring surface area.

10. A heat exchanger as defined in claim 6 further characterized by;

a second helical coil mounted in parallel with said first helical coil for parallel flow of said second fluid within both said first and second helical coils to said second chamber.

11. An oil cooler assembly for an automotive motor, said assembly characterized by;

a first coil tube mounted within a tank of a radiator for a motor;

said coil tube having an inlet end means for receiving lubricant fluid from without said tank and for allowing heat transfer from said lubricant fluid within said coil tube and through said coil tube to coolant flowing through said radiator; and said coil tube having an outlet end for transferring said lubricant fluid from within said coil to an inlet of an air-to-oil cooler where said lubricant fluid is further cooled by air flow about said air-to-oil cooler.

12. A heat exchanger as defined in claim 11 further characterized by;

said coil being helical.

13. A heat exchanger as defined in claim 12 further characterized by;

said helical coil tube having turbulence enhancing projections on an inside surface.

14. A heat exchanger as defined in claim 12 further characterized by;

said helical coil tube having extensions on its outer surface for increasing heat transferring surface area.

15. A heat exchanger as defined in claim 12 further characterized by;

a second helical coil mounted in parallel with said first helical coil for parallel flow of said lubricant fluid within both said first and second helical coils to said air-to-oil cooler.

* * * * *